US005898369A

United States Patent [19]

Godwin

[11] Patent Number: 5,898,369

[45] Date of Patent: Apr. 27, 1999

[54] COMMUNICATING HAZARDOUS CONDITION DETECTOR

[76] Inventor: Paul K. Godwin, 23871 Longacre, Farmington, Mich. 48335

[21] Appl. No.: 08/588,456

[22] Filed: Jan. 18, 1996

[51] Int. Cl.[6] ..... G08B 1/08

[52] U.S. Cl. ..... 340/539; 340/531; 340/628

[58] Field of Search ..... 340/531, 539, 340/628, 506; 455/83

[56] References Cited

U.S. PATENT DOCUMENTS

| | | | |
|---|---|---|---|
| 2,804,610 | 1/1957 | Curtis et al. | 340/590 |
| 3,559,194 | 1/1971 | Bisberg | 340/517 |
| 3,733,596 | 5/1973 | Arima | 340/518 |
| 3,753,258 | 8/1973 | Honda | 340/524 |
| 3,760,359 | 9/1973 | McQuown | 340/825.36 |
| 3,821,734 | 6/1974 | Herriberg et al. | 340/510 |
| 3,909,826 | 9/1975 | Schildmeier et al. | 340/599 |
| 3,961,323 | 6/1976 | Hartkorn | 340/539 |
| 4,027,276 | 5/1977 | Shaughnessy | 375/239 |
| 4,032,848 | 6/1977 | Shaughnessy | 340/539 |
| 4,081,795 | 3/1978 | Ogawa | 340/629 |
| 4,092,641 | 5/1978 | Bellinghausen et al. | 340/521 |
| 4,095,211 | 6/1978 | Shaughnessy | 340/539 |
| 4,207,558 | 6/1980 | Kunzer | 340/539 |
| 4,236,822 | 12/1980 | Jaretsky et al. | 340/628 |
| 4,357,602 | 11/1982 | Lemelson | 340/539 |
| 4,363,031 | 12/1982 | Reinowitz | 340/539 |
| 4,367,458 | 1/1983 | Hackett | 340/531 |
| 4,374,329 | 2/1983 | Schoenfelder et al. | 250/574 |
| 4,417,235 | 11/1983 | Del Grande | 340/531 |
| 4,488,044 | 12/1984 | Rork et al. | 250/381 |
| 4,539,556 | 9/1985 | Dederich et al. | 340/515 |
| 4,623,876 | 11/1986 | Shima et al. | 340/539 |
| 4,626,695 | 12/1986 | Keeler | 250/574 |
| 4,630,035 | 12/1986 | Stahl et al. | 340/539 |
| 4,673,920 | 6/1987 | Feruson et al. | 340/531 |
| 4,751,495 | 6/1988 | Whitman | 340/310.01 |
| 4,812,820 | 3/1989 | Chatwin | 340/531 |
| 4,916,432 | 4/1990 | Tice et al. | 340/518 |
| 4,951,029 | 8/1990 | Severson | 340/531 |
| 4,998,095 | 3/1991 | Shields | 340/574 |
| 5,148,159 | 9/1992 | Clark et al. | 340/825.22 |
| 5,252,960 | 10/1993 | Duhame | 340/825.56 |
| 5,355,524 | 10/1994 | Higgins, Jr. | 455/82 |
| 5,357,243 | 10/1994 | Tice | 340/825.07 |
| 5,382,943 | 1/1995 | Tanaka | 340/531 |
| 5,386,209 | 1/1995 | Thomas | 340/531 |

*Primary Examiner*—Donnie L. Crosland

[57] ABSTRACT

A hazardous condition detector system for a dwelling structure made up of independent detectors each capable of sensing the presence of a hazardous condition at its location, generating a local alarm and communicating, via a transmitted rf signal, the presence of a hazardous condition to other like detectors that receive such communication and to responsively generate their respective alarms.

24 Claims, 4 Drawing Sheets

COMMUNICATING HAZARDOUS CONDITION DETECTOR

FIELD OF THE INVENTION

The present invention is directed to the field of environmental safety devices and more specifically to the area of hazardous condition detection and warning systems.

BACKGROUND OF THE INVENTION

The use of conventional independent hazardous condition (e.g., carbon monoxide gas "CO" or combustion gases or particles, commonly known as "smoke") detectors throughout a dwelling structure is promoted as an accepted and desirable safety feature that facilitates an effective warning for the occupants of the structure. CO and smoke detector devices are readily available in most hardware and department stores at fairly reasonable cost. They are simple to install in various rooms of a dwelling. Although some units require connection to the electrical system of a dwelling for power, other units carry their own independent battery power sources. These detectors have become very popular and are commonly used. Each such detector monitors a condition, such as the ambient air in the case of CO or smoke detectors, in its respective local area and only the individual detector that senses a hazardous condition generates an alarm, a local alarm indication. Whenever one unit is activated other detectors in remote locations of the dwelling are not affected. An activated detector can warn the occupants of a dwelling within hearing distance of the activated detector when the alarm is audible, and within sighting distance when the alarm is a flashing light. While safety officials have continued to promote the use of these inexpensive independently powered units and encourage their use in every room in a dwelling structure, there is one important shortcoming of this type of alarm system: communication.

The problem with conventional independent hazardous condition detectors is that a detection of smoke or CO in one room of a house is not necessarily communicated to all the occupants of the dwelling at the very time it should be communicated. For instance, an audible alarm generated by an activated independent smoke detector located in a basement furnace room of a house may not be heard by occupants in second or third floor bedrooms. This is especially so at night where people sleep in bedrooms with closed doors. Even if other detectors are located in the various bedrooms and at the head of each stairway leading to those bedrooms, there is no contemporaneous warning communicated to the occupants. Only later, when the smoke seeps through the house in sufficient concentration is it sensed by one of those other detectors near the bedrooms and warning is given that alerts the nearby occupants. By this time, the dwelling may be so consumed in smoke or flames that the later alarm may not provide sufficient time for the occupants to escape safely.

Similarly, an alarm provided by an activated detector in a closed bedroom may not be heard or otherwise detected by occupants in other rooms soon enough to rescue those in the bedroom containing the activated detector.

Integrated systems for fire and smoke detection are known, in which several remote sensors are wire connected to a central control station within the dwelling. The central control station controls the activation of one or more distributed alarm devices when a hazardous condition is detected at any sensor location. That type of system can be configured to activate any or all alarm devices within its control and is therefore more desirable than the aforementioned system made up of conventional independent detectors. However, an integrated system requires extensive wiring to interconnect the control station to the various sensors and alarm devices located at various locations throughout the dwelling structure. An integrated system is usually installed during construction of a dwelling structure, in order to conceal the wires within the walls. If a building is retrofitted for such a system, the choice is to leave the wires exposed or proceed with the highly labor intensive process of routing the wires through existing walls and floors. In any event, the cost of the components utilized and the skilled labor involved to install such an integrated system is known to be relatively expensive and therefore not readily affordable by most consumers. In addition, an integrated system can only be expanded for additional coverage by running more wires to each newly monitored or alarmed locations.

SUMMARY OF THE INVENTION

The present invention eliminates several disadvantages of the prior art by providing an improved hazardous condition detection system which combines the low cost and easy installation attributes of independent detectors with communication attributes of an integrated system.

This invention is embodied in a distributed detection system which employs independent detectors that are capable of communicating with other such detectors having like capabilities within a dwelling. That is, each independent detector has the capability, when activated and while generating an audible and/or visible local alarm indication, to transmit a coded electromagnetic radio frequency (rf) alarm signal throughout the dwelling. This transmitted alarm signal is then received by one or more of such other detectors having the capability to receive and respond to the transmitted alarm signal and responsively generate a corresponding local alarm at each receiving detector.

Although not critical to an effective alarm system, the alarm indication produced by the detector actually sensing the hazardous condition may be distinguishably different from the alarms generated by the remotely located detectors which receive the rf transmissions. For instance, when the alarm indication produced by detectors is an audible sound made up of a certain combination of frequencies and repeated at a certain repetition rate, the alarm generated by the remotely located detectors receiving the rf transmission to indicate a hazardous condition at another location could be a different sounding audible alarm. The distinction could be a sound that is made up of different sets of frequencies or one that is pulsed at a slower repetition rate. This allows the occupants, once alerted, to locate the actual area of the hazardous condition, attempt to remedy the situation, make appropriate rescue and escape decisions or direct safety officials to the source of the condition.

While it is preferable that each detector unit have both transmit and receive capabilities, it is conceived that a less expensive system could be offered where all detector units have at least a transmit capability and some portion of the total have both transmit and receive capabilities. In such a system, the transmit-only units can be placed in the most remote and least likely occupied locations of the dwelling, such as the garage or the furnace room. In those locations, the potential for detecting hazardous conditions is greatest and local alarm indications provided there are least likely to be heard or otherwise sensed by the occupants in other areas of the dwelling. The full featured units, having both transmit and receive capabilities, can be placed throughout the remainder of the dwelling so as to receive transmissions from the transmit only detectors and each other when activated.

One advantage of the present invention is that the transmitters and receivers of the detectors are program coded by a simple switch mechanism or other similar device. This ensures that when an electromagnetic alarm signal is transmitted, it is coded to be received by other identically programmed detector units that contain receivers and are within the transmission range. Coding the alarm signal reduces the chances of interference with like systems in adjacent or neighboring dwellings where the range of rf transmission may carry over. The programming can be set by the manufacturer, but is flexible and simple enough to allow the user to change the programmed settings to another unique code, much like a user programs both a conventional garage door opener transmitter and receiver for common communication. In the event there is unwanted interference with a neighboring dwelling detector system, one only needs to reset the switch elements on each detector unit in one dwelling to a common setting that is different than the units of the neighboring dwelling.

Another advantage of the present invention is that additional units can be added to extend coverage of the system or to replace defective units by merely matching the switch mechanism and thereby reprogram the new units to have the same code as the previously installed units.

DETAILED DESCRIPTION

Figure 1:
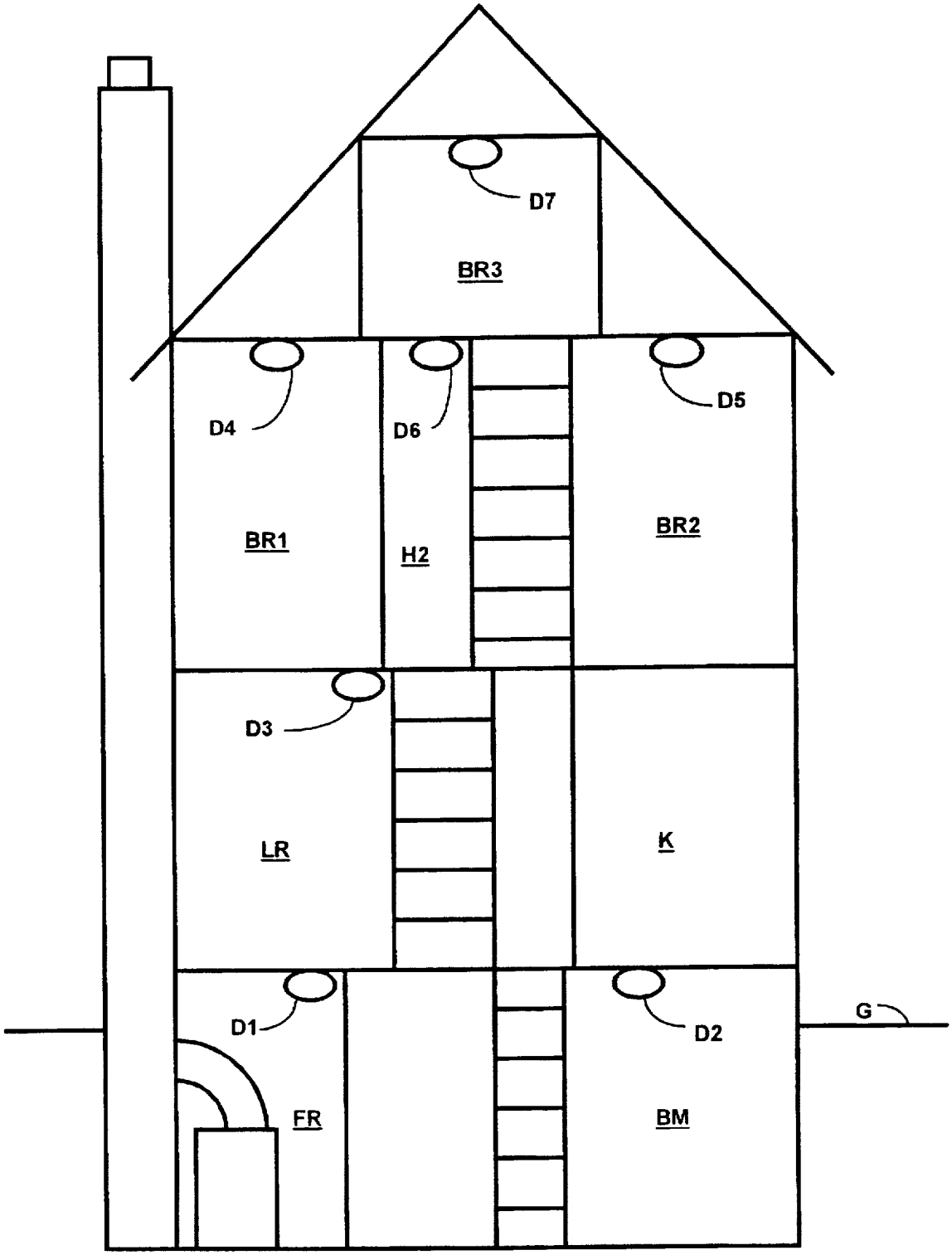
FIG. 1 is a plan view representing a multi-storied dwelling unit showing recommended locations of various hazardous condition detector units.

In FIG. 1, a multi-storied dwelling 1 is represented in which a furnace room FR and stairway are shown in the basement BM, below grade level G. Above G, a living room LR, stairway, and kitchen K are shown on the first floor. On the second floor, bedrooms BR1 and BR2, hallway H2 and stairway are shown. On the third floor, a single bedroom BR3 is shown. In this dwelling, independent hazardous condition sensors—in this case smoke detectors D1–D7—are located in the commonly recommended positions. That is, D1 in the furnace room FR and D2 at the other end of the basement BM. (If the furnace doesn't have a separate room enclosure, a single detector is adequate when located in the stairway leading up from the basement.) On the first floor, at least one detector D3 is recommended in the living room LR. Detectors D4, D5 and D7 are recommended in each of the bedrooms BR1, BR2 and BR3 and a detector D6 also is recommended above the top of the stairway leading up to hallway H2.

As mentioned in the Background, if conventional independent detectors are used and a detector in one part of the dwelling, for instance the furnace room FR is activated, it will sound a local alarm. (Some alarms are designed to also provide a visible alarm, for the purpose of alerting hearing impaired individuals.) An activation of a conventional detector in that remote location will most likely not be heard or otherwise sensed by a person sleeping in bedroom BR3. Likewise, an alarm sounded by a detector in bedroom BR3 will most likely not be heard or otherwise sensed by a person working in the kitchen K. In the case of conventional independent detectors, no communication is provided from one to the other. And, except for each individual detector locally detecting the hazardous condition as it migrates through the dwelling, there is no "system".

The present invention provides for improved independent hazardous condition detectors that, when properly installed in quantities of two or more, constitute an detection system that overcomes the communication deficiencies of conventional detectors.

Figure 2:
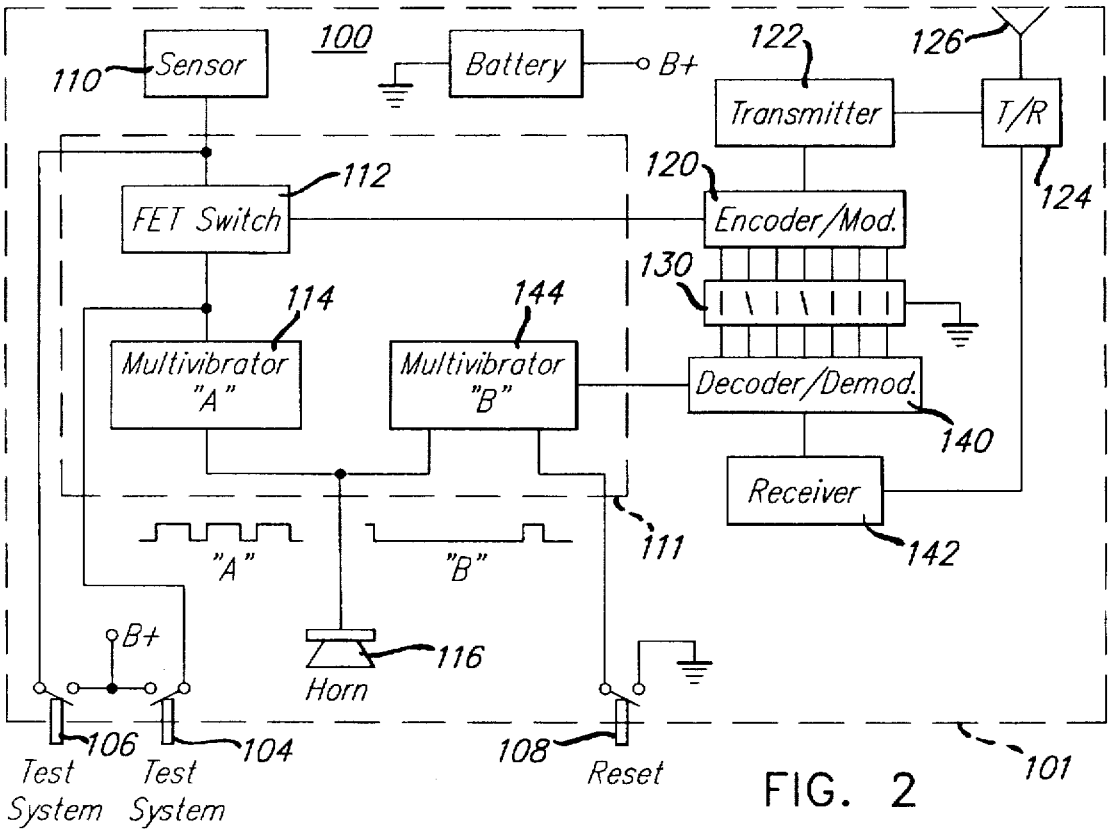
FIG. 2 is a block diagram of a hazardous condition detector unit of the present invention that embodies a digital transceiver.

In FIG. 2, a block diagram is used to illustrate an embodiment of the present invention. A hazardous condition detector 100 is shown as a self-contained unit, within a housing 101, which utilizes a battery for its independent electrical power source. The battery selected, in this case, is a 9 volt lithium type. However, any suitable long-life independent power source can be substituted, so long as it is capable of providing adequate service for an extended period, preferably for one or more years.

A sensor device 110 may be either a conventional CO sensor, intrusion sensor, natural gas sensor, toxic gas sensor, fire or one of the several smoke particle sensors that are known. For instance, the sensor 110 may be an ion chamber type smoke sensor as shown in U.S. Pat. Nos. 4,081,795 or 4,488,0144 (each incorporated herein by reference). Alternatively, sensor device 110 may be a photoelectric type as shown in U.S. Pat. No. 4,539,556 (incorporated herein by reference). Any appropriate device which is capable of sensing a predefined hazardous condition or event may be used.

Alarm circuitry 111 includes an FET (field effect transistor) Switch 112, a multivibrator 114 and a multivibrator 144. Alarm circuitry 111 is connected between the sensor 110 and a signaling horn 116. When sensor device 110 provides a sufficient output signal indicating that a hazardous condition exists, FET switch 112 becomes conducting and outputs a hazard signal that activates multivibrator 114 with a high logic level output. When multivibrator 114 is activated, it provides a local alarm output signal, which in turn activates horn 116 with pulses of a predetermined duration and at a repetition rate "A" (e.g., 3–4 times per second.) When sensor 110 no longer senses a hazardous condition, the output from sensor 110 drops to below a threshold level that causes FET switch 112 to become nonconducting (i.e., as a switch becomes opened) and provide a low logic level output that terminates the hazard signal. At that instant, multivibrator 114 is deactivated and terminates the local alarm signal. Responsively, horn 116 is silenced.

In addition to the components found in independent hazard condition detectors which provide local alarms for locally sensed hazards, the present invention includes a communication portion which also is shown in the FIG. 2 embodiment. The communication portion includes an rf transmitter 122, a receiver 142 and a common antenna 126. In this particular embodiment, a preset/settable code device 130 is connected to an encoder modulator 120 and a decoder demodulator 140. Encoder modulator 120 is connected to FET switch 112 of alarm circuitry 111 and transmitter 122. Decoder demodulator 140 is connected to the receiver 142 and multivibrator 144.

Code device 130, in this embodiment, is a set of "dip switches" that are used for the purpose of providing a parallel array of individual switches that are settable in open or closed to ground conditions. Code device 130 provides the digital code format that encoder modulator 120 uses to modulate the radio frequency signal produced by transmitter 122 when encoder modulator 120 is activated by the hazard signal from FET switch 112. Decoder demodulator 140 also is connected to code device 130 and provides a logic output signal when a digitally coded rf signal is received by receiver 142 and matches or sufficiently corresponds to the preset code.

Dip switches are selected for the coding device 130 in this embodiment because of their reliability, ease of use, and the fact that consumers who have purchased digital garage door openers are somewhat familiar with them. As with garage door openers, the purchaser of the detectors used in this system will be instructed to inspect and verify that the code device 130 is set to the same code in each detector installed in the same dwelling. It is expected that one could substitute other low cost coding devices to fulfill the functions offered by the dip switches shown, as long as each coding device provides a common code for both modulation and demodulation.

Upon receipt of a matching rf code, the output of decoder modulator 140 outputs a start pulse to multivibrator 144. Multivibrator 144 is a free-running type that is resettable to a quiescent condition and a Reset switch 108 is provided for this purpose. In response to the start pulse, multivibrator 144 runs and outputs a remote alarm signal that continues until Reset switch 108 is manually depressed. The remote alarm signal from multivibrator 144 activates alarm horn 116 with pulses of a predetermined duration and at a specific repetition rate "B" to indicate receipt of a remote alarm from another like detector that has sensed a hazardous condition. Although it is acceptable to have repetition rate B be the same as A, it is preferable that the warning sound provided by horn 116 be distinguishable between a locally detected condition and a remotely detected condition. In this embodiment, rate B is distinguishably slower, at a rate of approximately 1 per second.

Depending on the power of the rf signal generated by transmitter 122 and the sensitivity of receiver 142, it may be desirable to have a conventional transmit/receive (T/R) switch 124 located between the output of transmitter 122 and the input of receiver 142 in the antenna circuit. The embodiment shown in FIG. 2 includes the optional T/R switch 124, such as those which are conventionally known. T/R switch 124 acts to provide a low impedance path between antenna 126 and receiver 142 at all times except when transmitter 122 is transmitting an rf signal. At that time, T/R switch 124 provides a high impedance path between antenna 126 and the input of receiver 142. This protects receiver 142 from potential overload during transmissions.

In operation, detector 100 monitors both local conditions with its sensor 110 and remote conditions with receiver 142. If a hazardous condition exists locally and sensor 110 provides a sufficient signal level to cause FET switch 112 to switch from a nonconducting to a conducting state, the local alarm is given until the condition ceases to be sensed as hazardous, the detector is destroyed, or the battery is discharged. In addition to the local alarm, FET switch 112 provides a high logic level to encoder modulator 120 which causes transmitter 122 to transmit a coded rf signal. In remote locations of the dwelling where like detectors 100 with receivers are installed, the coded rf signal is received and compared by corresponding decoder demodulator 140 with the code provided by code device 130. When the received signal corresponds with the code, multivibrator 144 is started and causes horn 116 to be activated at repetition rate B until reset. Once multivibrator 144 is started, it will continue to run, even after the transmissions from the remote detector have ceased. This is an additional safety feature, since the sending detector's local alarm may cease because of battery drain or destruction of that detector by excessive heat or fire. Therefore, the alarm indicating a remotely sensed hazardous condition on each receiving detector will continue until its Reset switch is manually depressed and no correspondingly coded rf signal is received. Less expensive embodiments could be constructed which eliminate the reset feature and only provide an alarm indication as long as transmissions continue to be received.

For testing purposes, a Test Alarm switch 104, and a Test System switch 106 are provided. Test Alarm switch 104, when manually depressed, applies B+ voltage to multivibrator 114 to activate the local alarm until the Test Alarm switch is released. Test System switch 106, when manually depressed, applies B+ voltage to FET switch 112 and thereby activates the local alarm and the remote detectors. When the Test System switch 106 is released, the local alarm will cease, but the activated remote detectors will respectively continue until individually reset. Alternatively, a less expensive embodiment could be constructed which eliminates the Test Alarm feature in favor of a single Test System feature.

Figure 3:
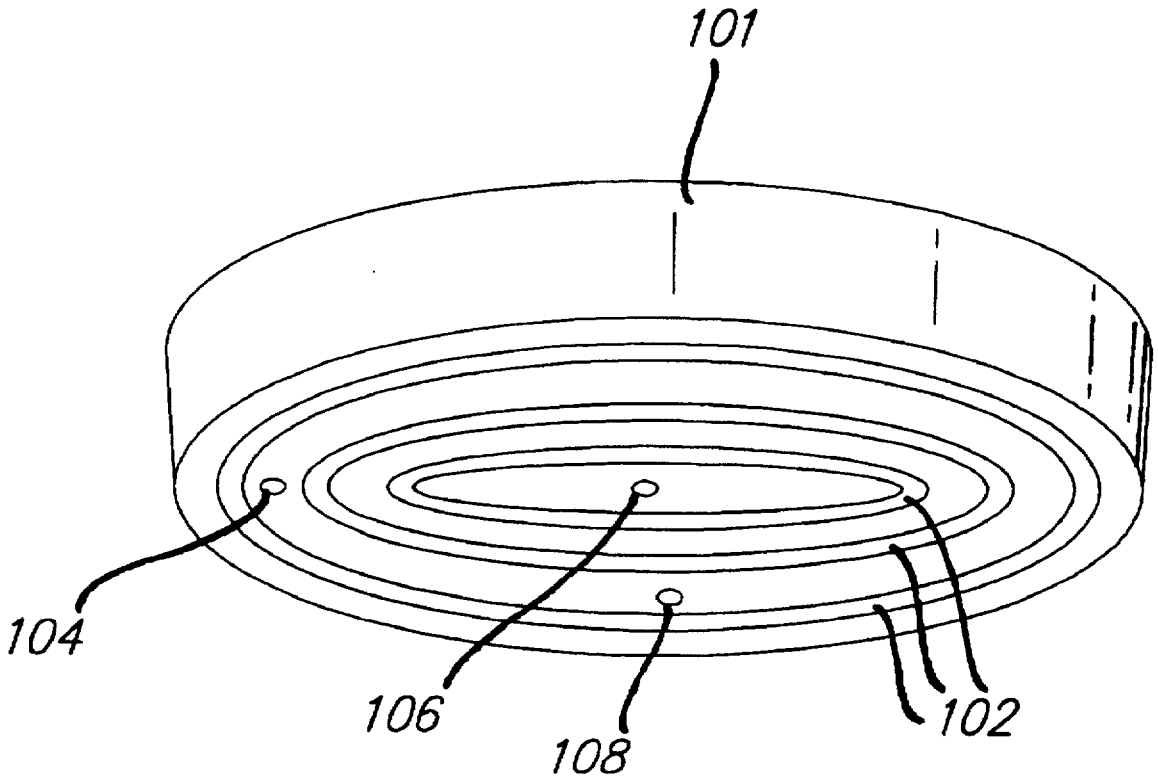
FIG. 3 is a perspective view of the housing for the detector shown in FIG. 2.

FIG. 3 illustrates an embodiment of the housing 101 of FIG. 2. The cup shaped housing 101 is molded from a plastic material that is non-shielding to rf electromagnetic transmissions. In this way, the antenna may be contained within the housing. Alternatively, depending on the frequency and the power generated, it may be necessary to have a small wire antenna projecting through the housing. Housing 101 has several openings 102 that allow for ambient air to enter and be monitored by the sensor of the detector. Test Alarm switch 104, Test System switch 106 and Reset switch 108 are shown protruding from the housing 101 for manual access. The housing should be readily removable by the purchaser for battery installation and inspection/verification or resetting of the code device 130.

Figure 4:
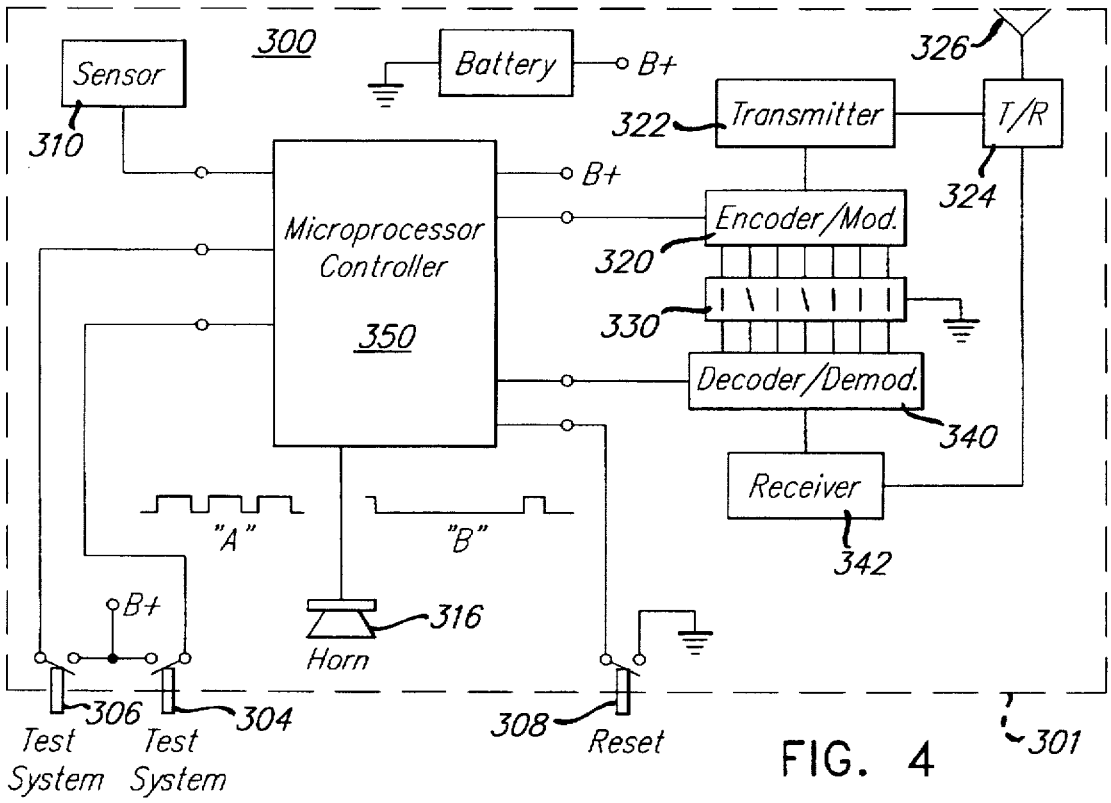
FIG. 4 is a block diagram of a hazardous condition detector unit of the present invention that utilizes a microprocessor controller.

In FIG. 4, another embodiment of the present invention is shown as detector 300 in a housing 301. Elements shown in FIG. 4 that are the same as elements shown in FIGS. 2 and 3 have identical two digit numerical identifiers in the three hundred series rather than the one hundred series. A microprocessor controller 350 serves as the alarm circuitry and is central to this embodiment. Controller 350 is connected to receive B+ power from a battery; to receive an output from a local hazardous condition sensor 310, and to provide appropriate output signals to an alarm indicator horn 316 and to an encoder modulator 320. In addition, controller 350 receives an output from a decoder demodulator 340, as well as operator commands from a Test Alarm switch 304, a Test System switch 306 and a Reset switch 308.

Controller 350 is programmed to respond to an output from sensor 310 and both provide an alarm indicative of a locally detected hazardous condition and cause a coded rf signal to be transmitted by transmitter 322. Controller 350 is further programmed to react to the receipt of correspondingly coded rf signals from another like detector to provide an alarm indicative of a remotely detected hazard.

Figure 5:
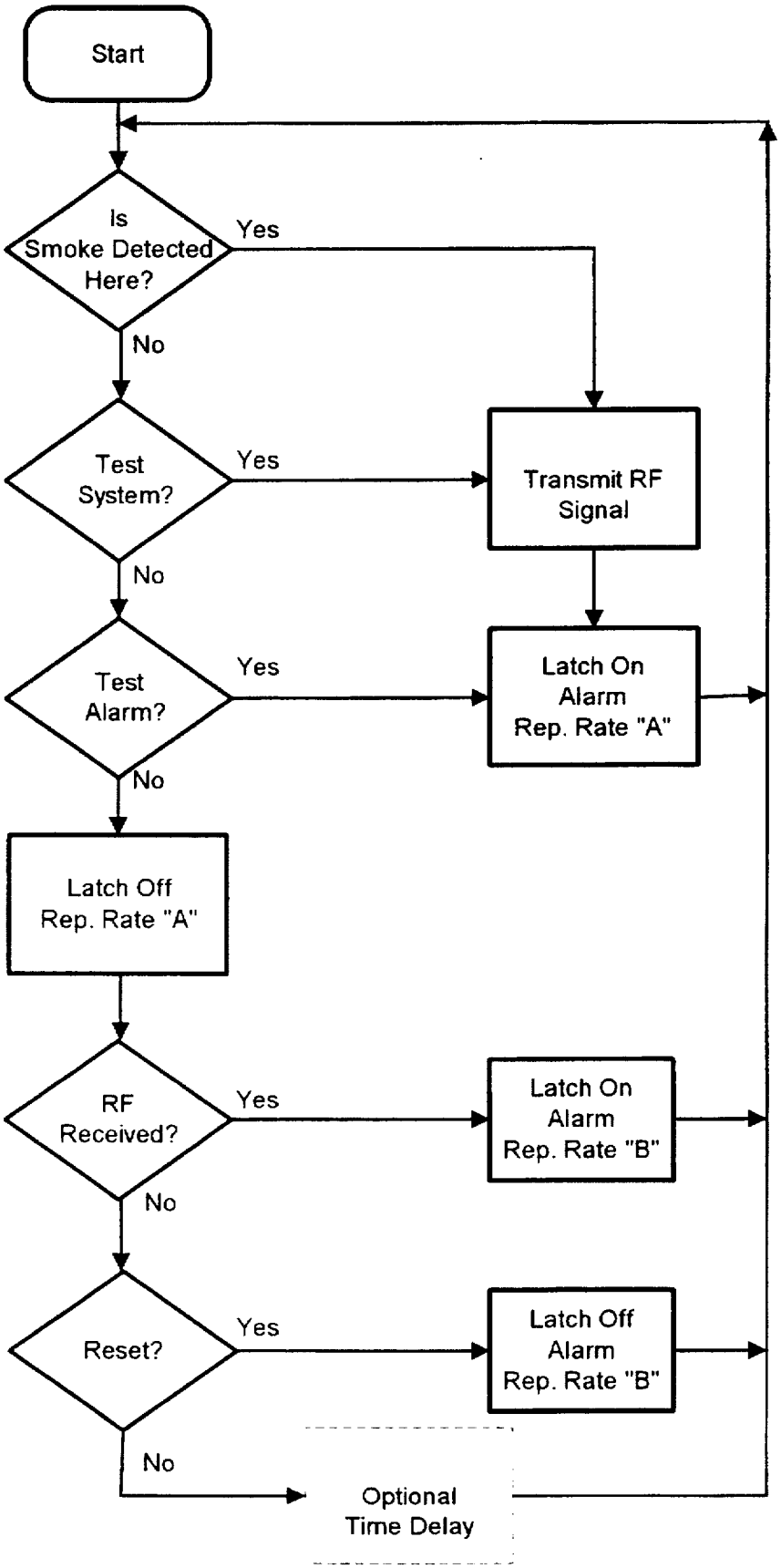
FIG. 5 is a flow chart representing a method for detecting a hazardous condition.

FIG. 5 is a flow chart which shows the steps followed by the programmed controller 350 in FIG. 4 and a method of implementing the present invention. At the start of the is program, an inquiry is made as to whether or not a hazardous condition exits (e.g., "Is smoke detected?") If the level of signal from the sensor 310 is sufficient, and the answer is "yes", the alarm device is ordered to be held (latched) in an activated state. In this case, the horn 316 is pulsed at a repetition rate "A". In the alternative, the controller 350 may provide a series of pulses that cause the horn to output a first combination of frequencies that uniquely indicate a locally sensed hazardous condition. Essentially simultaneously with the step of sounding the alarm device, a coded rf signal is transmitted so that other like detectors will receive an indication that a hazardous condition has been sensed at this detector's location.

If no hazardous condition exists (e.g., "No smoke is detected."), the program makes inquiry to determine if the Test System switch is depressed (closed). If yes, the alarm is ordered to be held latched in an activated state at repetition rate "A" and an rf signal is transmitted. If the Test System switch is not depressed (open), the system makes inquiry to determine if the Test Alarm switch is depressed (closed). If yes, the alarm is ordered to be held latched on in an activated repetition rate "A", but no rf signal is generated. If the test Alarm switch is not depressed (open), a command is produced which latches off the repetition rate "A". Therefore, if the prior affirmative conditions no longer exist, the local alarm is silenced.

Following the latch off command for repetition rate "A", the program makes inquiry to determine if a corresponding rf signal is being received. If yes, the alarm is ordered to be held latched on in an activated state at repetition rate "B" to indicate that a hazardous condition has been detected in another part of the dwelling. If no rf signal is detected, the program makes inquiry to determine if the Reset switch is depressed (closed). If yes, a command is produced which latches off the repetition rate "B". This silences the alarm if it had been previously activated by the received rf signal. If no, the program returns to the beginning and the steps again commence. It is believed that some systems which employ microprocessors, or future such devices that need to conserve battery power, may employ a time delay of several seconds between program cycles. Such a delay would most likely be employed following the Reset switch inquiry and negative result, since affirmative results to earlier inquiries would demand that the program be run continuously to keep the detector's reaction current. An optional delay step is represented in dashed line format in FIG. 5.

It should be understood that the foregoing description and the embodiments of are merely illustrative of many possible implementations of the present invention and are not intended to be exhaustive.

I claim:

1. An independent hazardous condition detector that provides a local alarm indication and an rf communication of the occurrence of a detected hazardous condition, comprising:

an independent power supply;

a hazardous condition detecting sensor for providing a hazard signal when a predefined hazardous condition is sensed;

alarm circuitry connected to said sensor for providing a local alarm signal when the existence of a hazardous condition is detected by the sensor;

an alarm indicating device connected to said alarm circuitry for receiving said local alarm signal and responsively providing a humanly detectable indication that a hazardous condition exists;

a radio frequency transmitter and an associated modulator connected to receive said hazard signal and transmit a coded rf signal upon the occurrence of a detected hazardous condition;

a programmable coding device for providing a modulation code to the modulator;

a radio frequency receiver and an associated demodulator, for receiving a coded rf signal transmitted from another like detector, connected to said alarm circuitry;

wherein said alarm circuitry provides a remote alarm signal to said alarm indicating device when such coded signal is received from another like detector;

said programmable coding device also provides a demodulation code to the demodulator that is identical to the modulation code; and said alarm indicating device, in the absence of said local remote alarm signal, responds to said remote alarm signal by providing a humanly detectable indication that a hazardous condition exists.

2. An independent hazardous condition detector as in claim 1, wherein said programmable coding device includes a user accessible switching device comprising a plurality of switches intended to be set to a code to match identical switching devices in other like detectors selected by the user.

3. An independent hazardous condition detector as in claim 1, wherein said coding device provides identical codes to the modulator and the demodulator, and a remote alarm signal is provided to said alarm circuitry when the received coded signal from another like detector corresponds to the code provided to the demodulator.

4. An independent hazardous condition detector as in claim 1, wherein said alarm circuitry provides said local alarm signal and said remote alarm signal to be distinguishable from each other and cause the alarm indicating device to provide correspondingly humanly distinguishable and detectable alarm indications.

5. An independent hazardous condition detector as in claim 4, further including a reset device connected to said alarm circuitry to terminate said remote alarm signal when said reset device is activated and until a coded signal is again received by said receiver.

6. An independent hazardous condition detector as in claim 5, wherein said reset device comprises a manually activated switch.

7. An independent hazardous condition detector as in claim 1, further including an antenna and a TR switch, wherein said transmitter and said receiver are connected to said antenna through said TR switch, and said TR switch provides a low impedance between the antenna and said receiver when said transmitter is not transmitting a coded rf signal and provides a high impedance between the antenna and said receiver while said transmitter is transmitting a coded rf signal.

8. An independent hazardous condition detector as in claim 1, further including a manually actuatable test switch connected to said alarm circuitry for activating said circuitry to simulate the occurrence of a locally sensed hazardous condition when actuated.

9. An independent hazardous condition detector as in claim 8, wherein said alarm circuitry outputs a local alarm signal to said alarm indicating device and a hazard signal to said modulator when said manually actuatable test switch is actuated.

10. A smoke detector intended for use in a multi-roomed structure wherein said detector provides a local alarm indication of a locally sensed alarm event and communicates said local alarm event to other remotely located like detectors and receives transmissions of alarm events from any of said other remotely located like detectors that transmit local alarm indications of their individually sensed alarm event, and said detector comprises:

a housing;

vent openings in said housing for allowing air to circulate within said housing, a smoke sensor disposed within said housing to receive and monitor air that circulates within said housing and provide a sensor output signal that varies in accordance with the amount of smoke sensed in said monitored air;

an alarm circuit within said housing, connected to said smoke sensor to receive said sensor output signal and provide a first output alarm signal when said monitored air is determined to contain smoke exceeding a predetermined concentration;

an alarm indicating device connected to said alarm circuit for providing an alarm indication that is humanly detectable within a limited area surrounding said detector when said first alarm signal is output from said alarm circuit;

an antenna mounted within said housing;

a transmitter for broadcasting a predetermined coded electromagnetic signal when said alarm circuit outputs a first alarm signal in response to said sensor output signal; and a receiver connected to said antenna and providing an output signal to said alarm circuit when an electromagnetic signal of said predetermined code is received from another like detector, wherein said alarm circuit provides a second output alarm signal to said alarm indicating device in response to the occurrence of an output signal from said receiver.

11. A detector as in claim 10, further including a TR switch connected to said antenna, and both said transmitter and said receiver are connected to said TR switch, wherein said TR switch maintains a low impedance path between said antenna and said receiver until said transmitter outputs a broadcast signal and at that time provides a high impedance path that prevents said transmitted electromagnetic signal from being received by said receiver.

12. A detector as in claim 10, wherein said alarm circuit provides said first output signal with a first periodic characteristic to said alarm signaling device, and provides said second output signal with a second periodic characteristic in response to the receiver output signal to said alarm signaling device which responsively provides a corresponding periodic alarm indication.

13. A detector as in claim 10, further including a manually actuatable test switch connected to said alarm circuit for activating said circuit to simulate the occurrence of a local alarm event when actuated.

14. A detector as in claim 13, wherein said alarm circuit outputs a first alarm signal to said alarm indicating device and said transmitter broadcasts said electromagnetic signal when said manually actuatable test switch is actuated.

15. A method of detecting a hazardous condition and providing an localized alarm indication and an rf communication of the occurrence of the detected hazardous condition in a hazardous condition detector, comprising the steps of:

sensing a hazardous condition and providing a hazard signal when a predefined hazardous condition is sensed locally;

responsively providing a humanly detectable indication that a hazardous condition exists locally;

providing a programmable coding device containing a selectively programmed code;

transmitting a coded radio frequency signal corresponding to the code programmed into the coding device, upon the occurrence of a locally detected hazardous condition;

receiving a coded rf signal transmitted from another like detector at another location operating according to a like method;

verifying that the received rf signal corresponds to said code provided in the programmable device; and responsive to said step of verification and, in the absence of providing said indication that a hazardous condition exists locally, providing a humanly detectable indication that an hazardous condition exists at another location.

16. A method as in claim 15, wherein said steps of providing humanly detectable indications of hazardous conditions are performed to provide indications that are humanly distinguishable between a locally sensed condition and a condition sensed at another location.

17. A method as in claim 15, further including the steps of providing a manually actuatable test switch, determining when said test switch is actuated and responsively performing said step of providing said humanly detectable indication that a hazardous condition exists.

18. A method as in claim 17, further including the step of responsively transmitting said coded signal following the step of determining that said test switch is actuated.

19. A single dwelling alarm system comprising at least two independent hazardous condition detectors provided in separate locations within a dwelling, in which each detector provides its own local first alarm and transmits a coded rf signal having a predetermined code when a hazardous condition is detected locally and further provides a local second alarm when a coded rf signal having said predetermined code is received from another like detector at a remote location, and wherein each detector comprises:

means for sensing a local predefined hazardous condition and responsively providing a hazard signal when such a local hazardous condition is sensed;

means for transmitting a coded rf signal having said predetermined code upon the occurrence of a hazard signal being provided by said sensing means;

means for receiving a coded rf signal having said predetermined code transmitted from another like detector at a remote location; and means responsive to said sensing means and to said receiving means for providing respectively corresponding and humanly detectable and distinguishable audible alarm indications that a hazardous condition is sensed either locally or at a remote location.

20. A system as in claim 19, wherein said responsive means of each detector provides an audible alarm indication that corresponds only to its own locally sensed hazardous condition in response to its corresponding sensing means providing a hazard signal.

21. An independent hazardous condition detector that provides a local first alarm indication and transmits a coded rf signal when a hazardous condition is detected locally and provides a local second alarm indication when an rf signal is received from another like detector at a remote location, comprising:

a hazardous condition detecting sensor for providing a hazard signal when a predefined hazardous condition is sensed locally;

alarm circuitry connected to said detecting sensor for providing a first alarm signal when the existence of a hazardous condition is locally sensed by said detecting sensor;

a code setting device in which a first predetermined code is set;

a radio frequency transmitter and an associated modulator connected to said code setting device and to said alarm circuitry to transmit a coded rf signal containing said first predetermined code, upon the occurrence of a locally sensed hazardous condition;

a radio frequency receiver and an associated demodulator connected to said code setting device, for receiving a coded rf signal containing said first predetermined code transmitted from another like detector at a remote location;

said alarm circuitry also being connected to said receiver and demodulator for providing a second alarm signal when a first predetermined coded rf signal transmitted from another like detector is received; and an alarm indicating device connected to said alarm circuitry for receiving said first alarm signal and responsively providing a first audibly detectable and local indication that a hazardous condition exists at said local location and, in the absence of said first alarm signal, for receiving said second alarm signal and responsively providing a second audibly detectable and local indication that a hazardous condition exists at a remote location.

22. An independent hazardous condition detector as in claim 21, wherein said alarm circuitry provides said first alarm signal and said second alarm signal to be distinguishable from each other to cause said alarm indicating device to provide correspondingly and audibly distinguishable alarm indications.

23. An independent hazardous condition detector that provides a local first alarm and transmits a coded rf signal when a hazardous condition is detected locally and provides a local second alarm when an identically coded rf signal is received from another like detector at a remote location, comprising:

means for sensing a local predefined hazardous condition and responsively providing a hazard signal when such a hazardous condition is sensed;

means for transmitting a coded rf signal in response to the occurrence of a hazard signal being provided by said sensing means;

means for receiving an identically coded rf signal transmitted from another like detector at a remote location; and means being responsive to said a hazard signal from said sensing means for providing a first audibly detectable alarm indication that a hazardous condition exists at said local location and, in the absence of said hazard signal, being responsive to said receiving means for providing a second audibly detectable alarm indication corresponding to a hazardous condition existing at a remote location.

24. An independent hazardous condition detector as in claim 23, wherein said alarm providing means provides a more urgent and recognizable audible alarm indication for said locally detected hazardous condition than the audible alarm indication provided for said remotely detected hazardous condition.

* * * * *